US007175045B2

(12) United States Patent
Bond

(10) Patent No.: US 7,175,045 B2
(45) Date of Patent: Feb. 13, 2007

(54) ARTICLE-DISPENSING OR VENDING MACHINE

(75) Inventor: Gregg Bond, Beverly Hills, CA (US)

(73) Assignee: The Helman Group, Ltd., Oxnard, CA (US)

( * ) Notice: Subject to any disclaimer, the term of this patent is extended or adjusted under 35 U.S.C. 154(b) by 90 days.

(21) Appl. No.: 11/123,742

(22) Filed: May 6, 2005

(65) Prior Publication Data

US 2006/0054632 A1 Mar. 16, 2006

Related U.S. Application Data

(60) Provisional application No. 60/569,179, filed on May 7, 2004.

(51) Int. Cl.
*G07F 11/00* (2006.01)
*B65G 59/00* (2006.01)

(52) U.S. Cl. ..... 221/194; 221/251; 221/123; 221/133

(58) Field of Classification Search ..... 211/59.2; 221/289, 296, 295, 301, 194, 195, 123, 124, 221/130, 131, 133, 251, 272, 208, 92
See application file for complete search history.

(56) References Cited

U.S. PATENT DOCUMENTS 514,948 A * 2/1894 Luster ..... 221/124
1,351,589 A * 8/1920 Vons ..... 221/251
2,159,905 A 5/1939 Moninger
2,877,928 A 3/1959 Patzer et al.
2,918,196 A * 12/1959 Lebron ..... 221/124
4,098,384 A 7/1978 Kovar
4,131,213 A 12/1978 Tamura et al.
4,289,254 A * 9/1981 Spring ..... 221/295
5,337,876 A 8/1994 McGee et al.
5,452,821 A 9/1995 Heath et al.
6,085,534 A 7/2000 Anthony
6,155,071 A 12/2000 Koyanagi

FOREIGN PATENT DOCUMENTS

JP 09027066 A * 1/1997
WO WO 02/03820 A1 1/2002

* cited by examiner

*Primary Examiner*—Gene O. Crawford
*Assistant Examiner*—Timothy Waggoner
(74) *Attorney, Agent, or Firm*—Lewis Anten; Ying Chen

(57) ABSTRACT

The present invention provides an article-dispensing machine or a vending machine, which includes a main body, one or more tracks for holding articles, one or more selection elements for selecting at least one article and one or more dispenser-controlling assemblies for controlling the release of at least one article in response to the operation of the one or more selection elements. According to the present invention, the tracks slope downwards along a releasing direction relative to horizontal direction, and the bevel angle of the tracks to horizontal direction is configured to ensure at least one article thereon able to move downwards by gravity. The article-dispensing machine employs a pure mechanical dispenser system, and can achieve the function of dispensing articles without electric power supply, which broadens its applications and saves power.

23 Claims, 4 Drawing Sheets

ARTICLE-DISPENSING OR VENDING MACHINE

This is a regular patent application based on U.S. Provisional Patent Application No. 60/569,179 filed on May 7, 2004.

BACKGROUND OF THE INVENTION

1. Technical Field

The invention generally relates to an article-dispensing machine or a vending machine for dispensing articles or merchandises, such as beverage cans, bottles and candy bars, etc.

2. Background Art

Now, article-dispensing machines or vending machines have been used very widely. For example, a vending machine may be seen in streets, office buildings, campuses or hospitals, even in shopping malls or companies. There are various conventional vending machines, which are electric-power driven and/or have a complicated mechanical structure. In some company offices, the article-dispensing machines may not be equipped with money collection function so that they may not be used as the vending machine in the streets.

The use of conventional vending machines is restricted by electric power supply, because selection element and/or dispenser-controlling assembly operate only by use of electric power. For example, in transferring of a merchandise or article from a track to a retrieval area by a dispenser-controlling assembly, it is necessary to use an electromotive device and other necessary mechanism. Moreover, conventional vending machines generally have complicated mechanical structures. Such vending machines are not only expensive, but also difficult for maintenance and have high failure rate.

SUMMARY OF THE INVENTION

It is an object of the present invention to provide an article-dispensing machine or vending machine, which may operate without electric power supply.

It is a further object of the present invention to provide an article-dispensing machine or vending machine, which has a simple mechanical structure.

It is a further object of the present invention to provide an article-dispensing machine or vending machine, which has a structure easy for operation and maintenance.

It is a further object of the present invention to provide an article-dispensing machine or vending machine, which can be mechanically operated for article dispensing and electrically cooled.

The present invention provides an article-dispensing machine or a vending machine, which has a main body, one or more tracks for holding articles, one or more selection elements for selecting at least one article and one or more dispenser-controlling assemblies. According to the present invention, the tracks slope downwards along a releasing direction relative to horizontal direction, and the bevel angle of the tracks to horizontal direction is configured to ensure at least one article thereon able to move downwards by gravity. In the present invention, the dispenser system comprised of the selection element, the tracks and the dispenser-controlling assemblies can be a pure mechanical structure and is able to operate without electric power supply.

Further according to the present invention, an article-dispensing machine, comprising a main body, one or more tracks for holding articles, one or more selection elements for selecting at least one article and one or more dispenser-controlling assemblies, wherein the selection elements and the dispenser-controlling assemblies are configured to be mechanically coupled in operation for dispensing at least one article on at least one said track. Each of the dispenser-controlling assemblies is fixed on a baffle plate of the related track, wherein the related baffle plate is at a side of the track and includes at least one opening to the space on the related track. The dispenser-controlling assemblies include at least one movable arm for extending into or withdraw from the space on the track, in response to the selection element, to control movement of the article on the track. Each of the dispenser-controlling assemblies further includes a rod, and the related selection element drives the rod to drive the at least one movable arm.

The present invention further provides an article-dispensing machine, comprising a main body, one or more tracks for holding articles, one or more selection elements for selecting at least one article and one or more dispenser-controlling assemblies. The track is a plate sloping downwards along a releasing direction relative to horizontal direction, and the bevel angle of the tracks to horizontal direction is configured to ensure at least one article thereon able to move downwards by gravity; the dispenser-controlling assemblies include at least one rod and at least one movable arm, wherein the movable arm is located before the first article on the track; and the rod is configured to be able to drive the movable arm in response to the selection element, such that the movable arm extends into the space on the track when the selection element is not operated, and withdraws from the space on the track when the selection element is operated.

Other features and details of the present invention are explained in detail referring to the figures in the following "Detailed Description of the Preferred Embodiments".

Based on stated above, it can be seen that the article-dispensing machine or vending machine provided by the present invention employs a pure mechanical dispenser system, and may achieve the function of dispensing merchandises without electric power supply, which broadens the applications and can save electric power. Moreover, as the vending machine is easily to fabricate and assemble due to simple construction, which reduces production cost and failure rate.

DETAILED DESCRIPTION OF THE PREFERRED EMBODIMENTS

Figure 1:
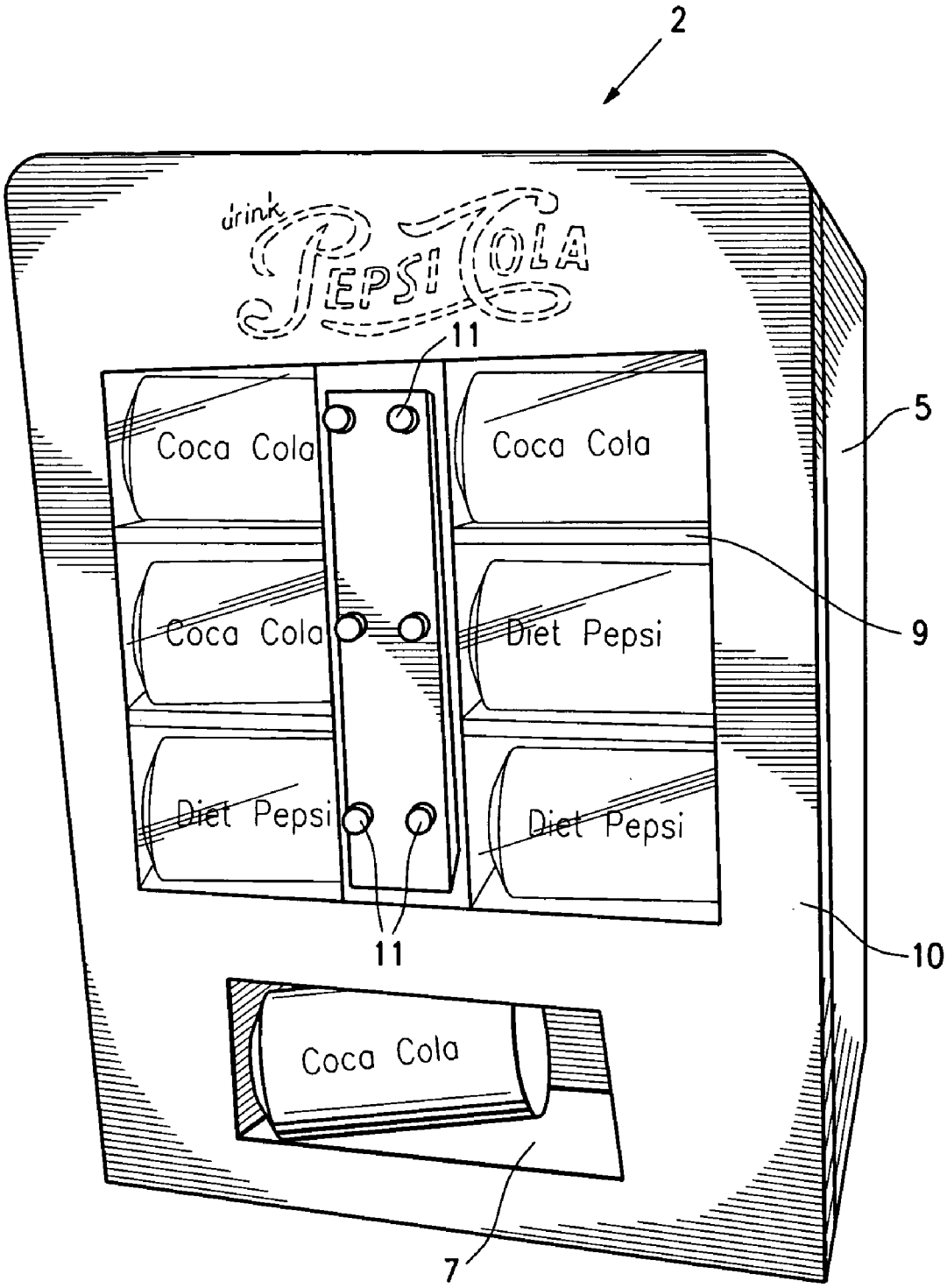
FIG. 1 is a solid view of an article dispensing machine or a vending machine of the present invention, wherein the article dispensing machine or a vending machine has been loaded with beverage cans.

FIG. 1 shows an article dispensing machine or a vending machine 2 having a dispenser system according to an embodiment of the present invention. The vending machine 2 comprises a main body 5, a loading door 10, one or more selection elements 12 for selecting at least one article or merchandise, one or more tracks 9 for holding the articles or merchandises, one or more dispenser-controlling assemblies 15 and a retrieval area 7. In the vending machine 2, the selection elements 12, the tracks 9 and the dispenser-controlling assemblies 15 are mechanically operated without electric power supply. And a selection element 12 is operated to mechanically activate the related dispenser-controlling assembly 15 to control the movement of merchandise or article on the related track. In use, when operating a selection element 12 for a desired merchandise type, the selection element 12 mechanically drive the movable elements of the related dispenser-controlling assembly 15 to allow the desired merchandise or article on the related track to move downwards by gravity and fall to the retrieval area 7. For example, as shown in FIG. 1, the first beverage cans on the right low track has fallen into the retrieval area 7 in the lower portion of the vending machine 2.

In FIG. 1, the vending machine 2 includes six selection elements 12, six dispenser-controlling assemblies 15, and six tracks, wherein a special selection element 12 is related to one particular dispenser-controlling assembly 15, and the special dispenser-controlling assembly 15 is related to one particular track. Generally, each track space can hold one or more merchandise or article of the same type, such as beverage cans/bottles and candy bars, etc.

In an embodiment of the vending machine 2 according to the present invention, the track is a plate which slopes downwards to a releasing direction relative to horizontal direction, and the retrieval area 7 is under the tracks. The term "releasing direction" refers to the direction in which merchandise moves on the track by gravity to reach the retrieval area 7 when a selection element 12 is operated.

The bevel angle of the tracks to horizontal direction is designed to ensure that different merchandises or articles thereon can move downwards along the track by gravity. The movement includes rolling motion or sliding motion. Generally, the bevel angle of a track holding merchandises which can roll may be less than that of a track holding merchandises which can only slide. In addition to the possible type of motion, the value of friction coefficient is considered to determine the value of the bevel angle, that is, if the friction coefficient larger, the bevel angle generally is larger. Therefore, the supporting surface of the track contacting with merchandise is often configured to be smooth. In certain cases, the bevel angle of the track may be designed to be adjustable, such that such a track can hold merchandises of different types and ensuring these merchandises able to move downwards along the track by gravity.

Figure 2:
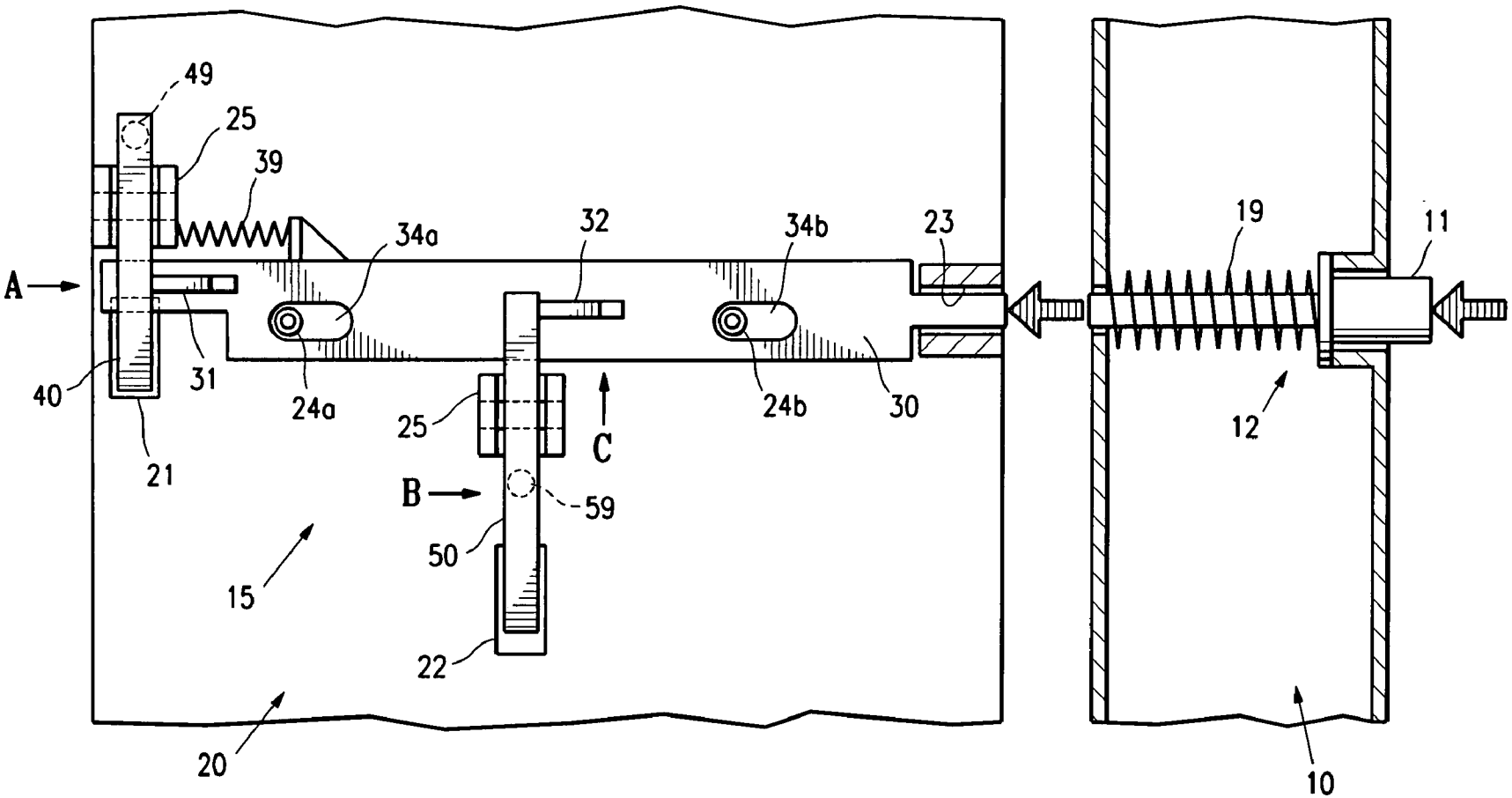
FIG. 2 is a schematic diagram of an embodiment for a dispenser system of the vending machine according to the present invention.

FIG. 2 is a schematic diagram of a part of dispenser system in the article-dispensing machine or vending machine 2 according to the present invention. In FIG. 2, the selection element 12 includes a restorable button 11, which is arranged on the loading door 10, and the front end of the restorable button 11 extends outwards from the inside of the loading door 10. The restorable button 11 achieves restoration by the restitution force of an elastic element 19 around the extended bar of the restorable button 11. It is noted that the movement of the restorable button 11 should ensure that the restorable button 11 is able to properly activate or drive the dispenser-controlling assembly 15.

In FIG. 2, the dispenser-controlling assembly 15 includes a first movable arm 40, a second movable arm 50 and a rod 30, which are attached on the baffle plate 20.

Figure 3:
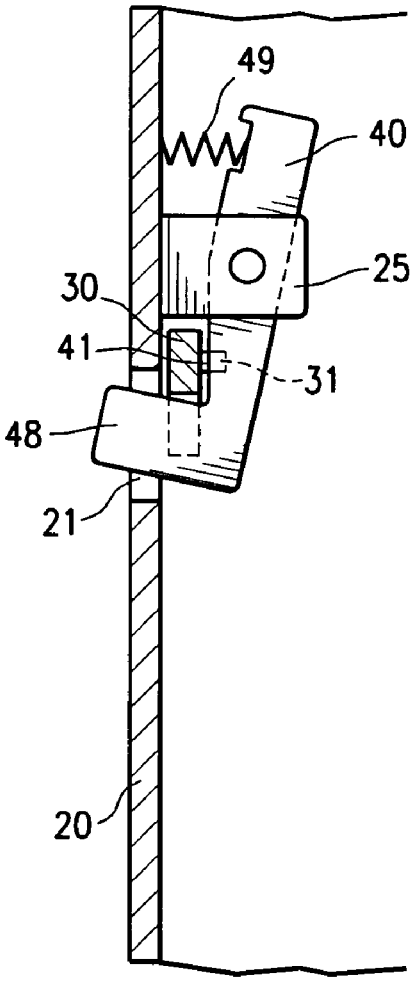
FIG. 3 is a schematic diagram of the portion of the first movable arm in the dispenser system, viewed along the arrow A in FIG. 2.

The location of the first movable arm 40 is positioned before all merchandise on the related track. The first movable arm 40, which is substantially of L-shape and has a free end 48, is rotatablely connected to the baffle plate 20 by a first pivoted support 25. There is provided a first elastic element 49 between one end of the arm 40 and the baffle plate 20 for restoring the position of the first movable arm 40 after operation. The first movable arm 40 will contact with the rod 30 at a first contact point 41, and the free end 48 of the first movable arm 40 and the first contact point 41 are located at the same side of the first pivoted support 25, as shown in FIG. 3. The free end 48 extends into the related track space through an opening 21 on the baffle plate 20 to block the merchandise or article during non-operation state. During operation state, the free end 48 may withdraw from the track space along the forward movement of the rod 30, and then extend into the track space again under the restoring force of the first elastic element 49 along the backward movement of the rod 30. The extended length of the free end is long enough to prevent the first merchandise or article on the track from moving downwards by gravity.

Figure 4:
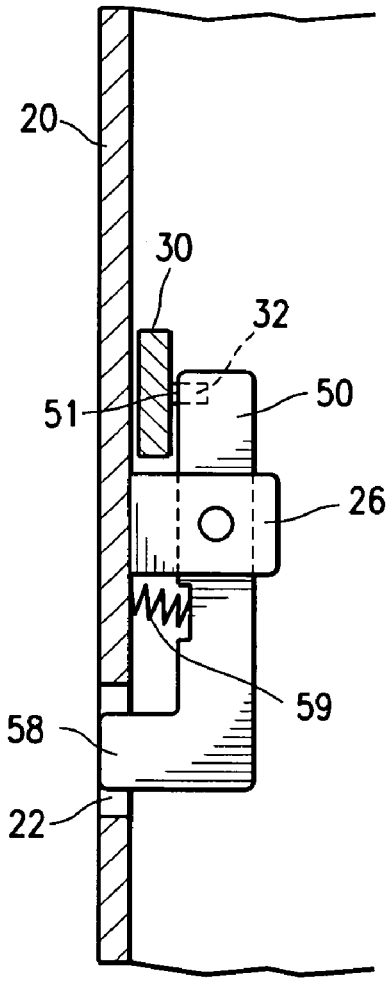
FIG. 4 is a schematic diagram of the portion of the second movable arm in the dispenser system, viewed along the arrow B in FIG. 2.

The second movable arm 50 is located at the back of the first merchandise but in front of the second merchandise on the track. The second movable arm 50, which is substantially of L-shape and has a free end 58, is rotatablely connected to the baffle plate 20 by a second pivoted support 26. There is provided a second elastic element 59 against the baffle plate 20. The second movable arm 50 may contact with the rod 30 at a second contact point 51, and the free end 58 of the second movable arm 50 and the second contact point 51 are located respectively at different sides of the second pivoted support 26, as shown in FIG. 4. During non-operation state, the free end 58 keeps away from the track space through an opening 22 on the baffle plate 20 so to allow the movement of any merchandise or article on the track. During operation state, the free end 58 will extend into the related track space along the forward movement of rod 30, at a length long enough to prevent other merchandises or articles on the related track except for the first merchandise from moving downwards by gravity, and then withdraws from the track space under the restoring force of the second elastic element 59 along the backward movement of rod 30.

The rod 30 aligns with the back end of the restorable button 11 by a guiding mechanism or assembly for guiding the movement of the rod. The guiding assembly includes a guiding hole 23 and two guiding pins 24*a* and 24*b*, and generally is formed on the baffle plate 20. The head portion of the rod 30 is inserted in the guiding hole 23, and two corresponding guiding slots 34*a* and 34*b* are formed in the rod 30 to receive the guiding pins 24*a* and 24*b*, respectively. A rod elastic element 39 is provided between the back end of the rod 30 and a bulge of the baffle plate along the moving direction of the rod 30, i.e. the longitudinal direction of the rod 30, to restore the position of the rod after its operation, as shown in FIG. 2.

Figure 5:
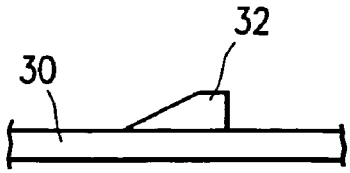
FIG. 5 is a schematic diagram of the portion of a protuberance in the dispenser system, viewed along the arrow C in FIG. 2.
Figure 6:
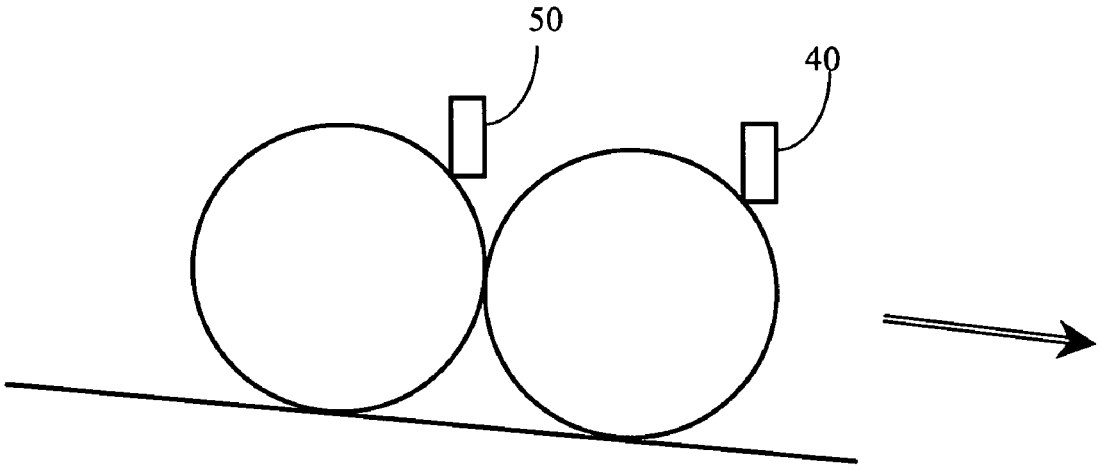
FIG. 6 is a partial side view illustrating two moveable arms and two items held on a tract of a vending machine according to an embodiment of the present invention.

The rod 30 has a first protuberance 31 having a slope and a second protuberance 32 having a slope, wherein an exemplary shape of these slopes is as shown in FIG. 5. Along the forward movement of the rod 30, the first protuberance 31 push the first movable arm 40 to make its free end 48 withdraw from the related track space, while the second protuberance 32 push the second movable arm 50 to make its free end 58 extend into the same track space. It is noted that the first protuberance 31 and the second protuberance 32 may have different slope shapes, and the height or angle of the slopes should ensure that the free end of corresponding movable arm can sufficiently withdraw from and extend into the related track space.

When the restorable button 11 is in an unpressed or non-operated position, the free end 48 of the first movable arm 40 extends sufficiently into the related track to prevent the article or merchandise on the track from moving downwards by gravity; and the free end of the second movable arm 50 is at a withdrawal position from the track, not affecting the movement of merchandise on the track downwards by gravity.

When the restorable button 11 is pressed or operated, its back end pushes the rod 30 forwards. As the rod 30 moves forwards, the first protuberance 31 of the rod 30 pushes the first movable arm 40 to rotate at the first contact point to make the free end 48 of the first movable arm 40 withdraw from the track space; the second protuberance 32 of the rod 30 pushes the second movable arm 50 to rotate at the second contact point to make the free end 58 of the second movable arm 50 extends into the track space. Therefore, when the restorable button 11 is in the operation or working position, the free end of the first movable arm 40 does not prevent merchandise on the track from moving downwards by gravity, and allow the first merchandise move along the released direction to leave the track and fall into the retrieval area 7 through a channel; the free end 58 of the second movable arm 50 extends into the related track to prevent other merchandise on the same track except for the first merchandise from moving downwards by gravity.

When the restorable button 11 is released, the rod 30 returns to its original position by the restitution force of the rod elastic element 39. During this process, the free end 48 of the first movable arm 40 extends into the track space by the restitution force of the first elastic element 49; the free end 58 of the second movable arm 50 withdraws from the track space by the restitution force of the second restore elastic element 59. As the first merchandise on the related track has left the track and fallen to the retrieval area 7 at this time, the next merchandise closely following the first merchandise moves to the position of the first merchandise by gravity, and is held up by the first movable arm 40 to become the next merchandise to be released.

In the above-mentioned embodiment of the vending machine 2, the dispenser system are achieved by use of the dispenser-controlling assembly 15 comprised of the rod 30, the first movable arm 40 and the second movable arm 50. The longitudinal movement of the selection element 12 is transferred into the related transverse movements of the first and second movable arms 40, 50 to control the movement of the merchandises or articles on the related track 9. The article-dispensing machine or vending machine having such a dispenser system can be mechanically operated without electric power supply, and has a simple mechanical structure easy for operation and maintenance. Although the particular structure has been disclosed, it is apparent to those skilled in the art that various changes or modifications can be made. As examples, a few alternative embodiments are given as follows.

In an alternative embodiment of the vending machine 2, it is not necessary to only release a single merchandise or article per operation of a selection element 12. For example, in the above embodiment, the amount of released article(s) per operation is equal to the amount of the article(s) between the first movable arm 40 and the second movable arm 50. Therefore, if the second movable arm 50 is arranged after the second article and before the third article, the amount of released articles per operation is two. Further, it should be appreciated that the second movable arm may be unnecessary, but then if no the second movable arm 50, all article(s) on the related track will be released, which may be advantageous to those mini vending machines wherein a track only holds an article or to those vending machines used in some special application.

In an alternative embodiment of the vending machine 2, the selection element 12 may be a rotary knob, and the dispenser-controlling assembly 15 may include a camshaft having two different curve shape cams and two moveable arms. The rotation of the rotary knob are transferred into the related extending or withdrawing transverse movements of the movable arms by the camshaft, and is not described in detail herein.

In another embodiment of the vending machine 2, a selection element 12 may be designed to drive two or more dispenser-controlling assemblies, simultaneously or respectively. For example, the structure for simultaneously controlling two dispenser-controlling assemblies can be achieved by adding two protuberances on the rod 30 and two corresponding movable arms similar to the first and second movable arms 40, 50 at appropriate positions. For example, the structure for controlling two dispenser-controlling assemblies and tracks can be achieved by a bidirectional rotary knob and a camshaft having four different curve shape cams and four moveable arms, that is, for example, when the bidirectional rotary knob is turned clockwise, the movement of the merchandises or articles on the related track on the left side of the camshaft is controlled, and vice versa.

In addition, in an embodiment of the vending machine 2, the loading door may include a see-through window made of glass or plastic so that the beverage cans may be viewed. Further, an opening to access the retrieval area 7 may be formed at the lower portion of the loading door.

In another embodiment of the vending machine 2, the vending machine 2 may further comprise a cooling system so that merchandises therein can be cooled if electric power supply is available. In addition, the vending machine 2 may be equipped with a known money collection device. Specially, the money collection device can be a known mechanism.

It can be seen from the above various embodiments that, a number of changes and modifies may be made without departing from the spirit and range of the present invention, of which the protection scopes should be broad and not limited any embodiment, and only defined by the attached claims.

What is claimed is:

1. An article-dispensing machine comprising:

a main body;

one or more tracks for holding articles;

one or more baffle plates each located on a side of a track and including at least one opening to the corresponding track;

one or more selection elements each for selecting an article held in a corresponding track; and one or more dispenser-controlling assemblies each corresponding to a track and fixed on a corresponding baffle, each dispenser-controlling assembly including a first movable arm located before all articles on the corresponding track, a first pivoted support rotatablely connecting the first movable arm to the baffle plate, and a first restore elastic element disposed against the first movable arm and the baffle plate, wherein a free end of the first movable arm is extendable into a space of the corresponding track through one of the at least one opening of the baffle plate, wherein when the corresponding selection element is in a non-operation position, the first movable arm extends sufficiently into the corresponding track to prevent any article behind it on the corresponding track from moving downwards by gravity, and when the corresponding selection element is in an operation position, the first movable arm withdraws from the corresponding track.

2. The article-dispensing machine of claim 1, wherein the first movable arm has an L-shape.

3. The article-dispensing machine of claim 1, wherein each dispenser-controlling assembly further includes a second movable arm located after a first article on the corresponding track; and when the corresponding selection element is in the operation position, the second movable arm extends sufficiently into the corresponding track to prevent any article behind it on the corresponding track from moving downwards by gravity; and when the corresponding selection element returns from the operation position to the non-operation position, the second movable arm withdraws from the corresponding track.

4. The article-dispensing machine of claim 3, wherein the dispenser-controlling assembly further includes a second pivoted support rotatablely connecting the second movable arm to the baffle plate and a second restore elastic element disposed against the second movable arm and the baffle plate; and wherein a free end of the second movable arm is extendable into a space of the corresponding track through another one of the at least one opening.

5. The article-dispensing machine of claim 3, wherein the second movable arm has an L-shape.

6. The article-dispensing machine of claim 1, wherein each dispenser-controlling assembly further includes a rod, and the corresponding selection element drives the rod to make the first movable arm move.

7. The article-dispensing machine of claim 6, wherein each dispenser-controlling assembly further includes a guiding assembly for aligning the rod with a back end of the corresponding selection element and a rod restore elastic element disposed against the baffle plate.

8. The article-dispensing machine of claim 6, wherein the rod includes a first protuberance having a slope for pushing the first movable arm to rotate and withdraw from the corresponding track.

9. The article-dispensing machine of claim 3, wherein each dispenser-controlling assembly further includes a rod, and the corresponding selection element drives the rod to make the first and second movable arms move, wherein the rod includes a first protuberance having a slope for pushing the first movable arm to rotate and withdraw from the corresponding track, and a second protuberance having a slope for pushing the second movable arm to rotate and extend into the corresponding track.

10. The article-dispensing machine of claim 1, wherein each selection element is mechanically coupled with a single dispenser-controlling assembly; and each dispenser-controlling assembly is mechanically coupled with a single track.

11. An article-dispensing machine, comprising:

a main body having a loading door;

one or more tracks for holding articles;

one or more dispenser-controlling assemblies each corresponding to a track; and one or more restorable selection buttons each corresponding to a selection assembly for selecting at least one article the corresponding track;

wherein each restorable selection button is arranged on the loading door with a front end extending from an outer surface of the loading door and a back end mechanically coupled to the dispenser-controlling assembly.

12. An article-dispensing machine comprising:

a housing;

one or more tracks located in the housing for holding articles, the tracks having a bottom surface sloping downwards such that the articles thereon are urged by gravity in a release direction;

one or more baffle plates each located on a side of a track and including at least one opening to the corresponding track;

one or more selection elements on the housing each corresponding to a track;

one or more dispenser-control assemblies each associated with a track and activated by the corresponding selection element, each dispenser-control assembly including:

a first blocking member being movable between a first state that prevents an article upstream from the first blocking member from moving in the release direction and a second state that allows an article upstream from the first blocking member to move in the release direction pass the first blocking member;

a second blocking member located upstream from the first blocking member by a distance sufficient to hold an article between the first and second blocking members, the second blocking member being movable between a first state that allows an article upstream from the second blocking member to move in the release direction pass the second blocking member and a second state that prevents an article upstream from the second blocking member from moving in the release direction; and an activation member mechanically coupled to the corresponding selection element and to the first and second blocking members so that when the selection element is activated, the activation member causes the first blocking member to move from the first state to the second state and the second blocking member to move from the first state to the second state, and when the selection element is released, the activation member causes the first blocking member to move from the second state to the first state and the second blocking member to move from the second state to the first state, whereby when the selection element is activated, an article located between the first and second blocking members are allowed to move in the release direction to be released and an article located upstream from the second blocking member is blocked, and when the selection element is released, an article upstream from the second blocking member is allowed to move in the release direction to the location between the first and second blocking members and be held there, wherein each of the dispenser-control assemblies is fixed on the baffle plate of the corresponding track, and wherein one of the first and second blocking member includes a movable arm rotatablely connected to the baffle plate, a pivoted support rotatablely connecting the movable arm to the baffle plate, and a restore elastic element disposed against the movable arm and the baffle plate, wherein a free end of the movable arm is extendable into a space of the corresponding track through one of the at least one opening of the baffle plate.

13. The article-dispensing machine of claim 12, wherein the movable arm has an L-shape.

14. The article-dispensing machine of claim 13, wherein each dispenser-control assembly further includes a rod, and the corresponding selection element drives the rod to make the movable arm move.

15. The article-dispensing machine of claim 14, wherein each dispenser-controlling assembly further includes a guiding assembly for aligning the rod with a back end of the corresponding selection element and a rod restore elastic element disposed against the baffle plate.

16. The article-dispensing machine of claim 15, wherein the rod includes a first protuberance having a slope for pushing the movable arm to rotate and extend into or withdraw from the corresponding track.

17. The article-dispensing machine of claim 12, wherein each selection element is mechanically coupled with a single dispenser-control assembly and each dispenser-control assembly is mechanically coupled with a single track.

18. An article-dispensing machine comprising:

a main body;

one or more tracks for holding articles;

one or more baffle plates each located on a side of a track and including at least one opening to the corresponding track, one or more selection elements each for selecting an article held in a corresponding track; and one or more dispenser-controlling assemblies each corresponding to a track and fixed on a corresponding baffle plate, each dispenser-controlling assembly including a movable arm located after a first article and before a second article on the corresponding track, a pivoted support rotatablely connecting the movable arm to the baffle plate, and a restore elastic element disposed against the movable arm and the baffle plate, wherein a free end of the movable arm is extendable into a space of the corresponding track through one of the at least one opening of the baffle plate, wherein when the corresponding selection element is in an operation position, the movable arm extends sufficiently into the corresponding track to prevent any article behind it on the corresponding track from moving downwards by gravity, and when the corresponding selection element is in a non-operation position, the movable arm withdraws from the corresponding track.

19. The article-dispensing machine of claim 18, wherein the movable arm has an L-shape.

20. The article-dispensing machine of claim 18, wherein each dispenser-controlling assembly further includes a rod, and the corresponding selection element drives the rod to make the movable arm move.

21. The article-dispensing machine of claim 20, wherein each dispenser-controlling assembly further includes a guiding assembly for aligning the rod with a back end of the corresponding selection element and a rod restore elastic element disposed against the baffle plate.

22. The article-dispensing machine of claim 20, wherein the rod includes a protuberance having a slope for pushing the movable arm to rotate and extend into the corresponding track.

23. The article-dispensing machine of claim 18, wherein each selection element is mechanically coupled with a single dispenser-controlling assembly; and each dispenser-controlling assembly is mechanically coupled with a single track.

* * * * *